US005511406A

United States Patent [19]

Panasiuk et al.

[11] Patent Number: 5,511,406

[45] Date of Patent: Apr. 30, 1996

[54] SPLIT CUSHION PIN SYSTEM FOR ROLLING BOLSTER

[75] Inventors: Lubomir M. Panasiuk, Warren; David J. Heide, Allen Park; Raymond P. Lievens, Sterling Heights, all of Mich.

[73] Assignee: General Motors Corporation, Detroit, Mich.

[21] Appl. No.: 238,829

[22] Filed: May 4, 1994

[51] Int. Cl.[6] ..... B21D 24/08

[52] U.S. Cl. ..... 72/453.13; 72/446

[58] Field of Search ..... 72/453.13, 446, 72/448

[56] References Cited

U.S. PATENT DOCUMENTS

| | | | |
|---|---|---|---|
| 3,111,100 | 11/1963 | Georgeff | 72/446 |
| 4,905,556 | 3/1990 | Haack et al. | 72/446 |

FOREIGN PATENT DOCUMENTS

| | | | |
|---|---|---|---|
| 0221172 | 7/1958 | Austria | 72/448 |
| 3404307 | 8/1985 | Germany | 72/453.13 |

*Primary Examiner*—David Jones

*Attorney, Agent, or Firm*—Jeffrey A. Sedlar

[57] ABSTRACT

A two piece cushion pin system including a cushion pin carried in the bed of a press engaging the cushion and a cushion pin extension carried in a rolling bolster engaging the cushion pin and the die mounted on the bolster. The bolster is rolled into and out of the press with the cushion pins and cushion pin extensions in place.

6 Claims, 2 Drawing Sheets

SPLIT CUSHION PIN SYSTEM FOR ROLLING BOLSTER

BACKGROUND OF THE INVENTION

The present invention relates to a rolling bolster system.

With machines such as presses, forming tools such as the dies that are used therein, must be replaced from time to time for maintenance purposes or to produce different parts with the machine. Replacement of a die results in lost time because the press must be shut down while the die is being changed. Die changes can occur relatively frequently in manufacturing facilities. Die changes occur even more frequently at prototype facilities where parts are produced in relatively small lots. Therefore, in order to maintain press productivity it is essential that die changes occur rapidly.

It is conventional to equip presses with rolling bolsters to facilitate die changing. A rolling bolster is a mechanism that allows the press platen or "bolster" to move into and out of the press. When the bolster is out of the press, removal and replacement of the die is simplified.

One of the complications involved in rolling the bolster of a press that is so equipped, is the fact that in a press with cushion action, pins typically extend between the die and the cushion through the press bed and the bolster. The pins prevent movement of the bolster when they are in place.

The cushion pins provide a secondary action to the die which is mounted on the bolster. The pins engage mating sections of the die, providing secondary movement thereto in addition to the normal primary closing movement of the press. The pin driven secondary action of a particular die is generally unique to the part produced therein. Therefore, placement of the pins in the bolster varies according to the die mounted thereon.

The bottom of the pins typically engage a cushion located in the bed of the press. The cushion's slide mechanism generally provides movement to the pins pushing them through the bolster to engage the die. Conventionally, the bottom of the pin remains in contact with the slide mechanism due to the force of gravity.

Because the pins extend through the bed of the press and through the bolster, rolling the bolster out of the press conventionally requires the removal of the pins. Depending on the application, numerous pins are typically involved. Therefore, movement and replacement of the pins increases press down time. This is because the pins are relatively heavy and must be manually removed from within the press after the die has been removed and before the bolster can be rolled out.

SUMMARY OF THE INVENTION

To enable rolling a bolster out of a press that uses cushion pins, prior to die removal, the present invention provides a split cushion pin system. According to this invention, the lower portion of the cushion pin is carried within the bed of the press and may remain there regardless of the particular die that is selected and mounted on the bolster to run in the press. A mating cushion pin extension is carried in the bolster that permits rolling the bolster out of the press with the cushion pin extensions in place.

When the cushion slide is activated the cushion pins engage the cushion pin extensions providing the required movement to the die section. Because the cushion pin in the bed of the press and the cushion pin extension in the bolster are separate components, the bolster is rolled out of the bed of the press for selective removal and replacement of the die without removal of the pins. When the die is removed, the cushion pin extensions are removed and replaced as required and the next die is mounted on the bolster. The bolster is then rolled back into the press.

Providing the split pin system enables rolling the bolster out of the press while the pins are in place. This facilitates die change, reducing press down time thereby increasing productivity. The split pin system is a low cost means of providing an effective rolling bolster system with a minimum of physical change to the press. In addition, the pins can be accessed when the bolster has been rolled out of the press and the die removed. Only the cushion pin extensions, which weight significantly less than a single full pin, must be handled during die changes.

DETAILED DESCRIPTION OF THE PRESENTLY PREFERRED EMBODIMENT

The invention is described in detail within the context of a hydraulic press with cushion action. It will be apparent that the invention is applicable outside of this context wherever a rolling bolster is incorporated in a machine that utilizes a die with secondary action.

Figure 1:
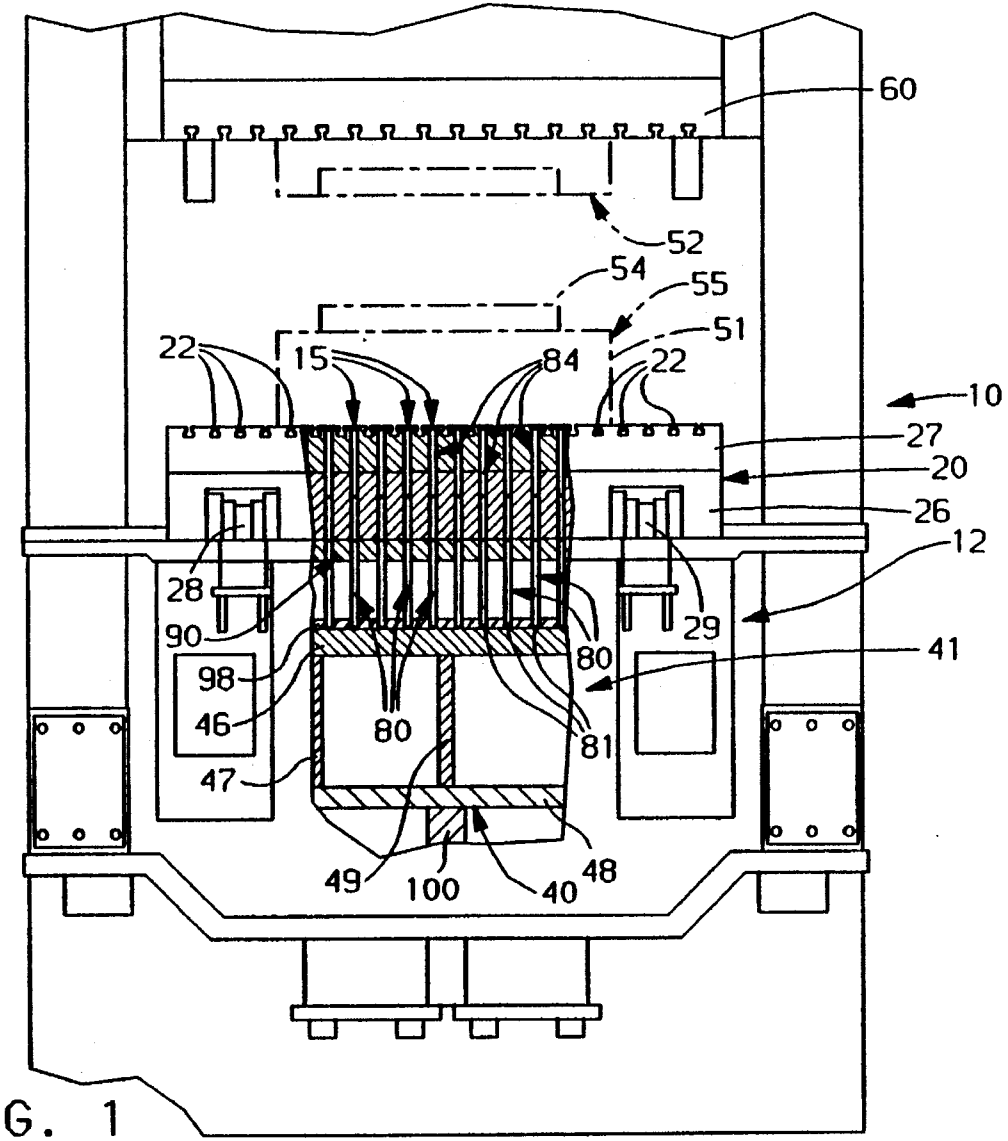
FIG. 1 is a fragmentary cross-sectional view of a press.

Illustrated in FIG. 1 is a press 10 that includes a press bed area 12 upon which a bolster 20 is mounted. The bolster 20 is comprised of base plate 26 and mounting plate 27 which includes a plurality of T-slots represented by T-slots 22. Base plate 26 includes rollers 28 and 29 that aid in rolling bolster 20 into and out of press 10.

The T-slots 22 provide a convenient means of mounting lower die half 55 to the bolster 20. Upper die half 52 is similarly mounted to press ram 60 press ram 60 provides vertical opening and closing motion to upper die half 52 to mate with lower die half 55. Die halves 55 and 52 provide a means of forming a workpiece (not illustrated).

Located within the press bed 12 is cushion 41. Cushion 41 includes cushion slide 40, that is moveable in a vertical direction. Cushion slide 40 as partially shown is comprised of plates 46, 47, 48 and 49.

Cushion slide 40 carries a plurality of cushion pins, represented by cushion pins 80. Cushion slide 40 imparts vertical movement to cushion pins 80. The bases 81 of pins 80 engage the top of cushion slide 40 at top plate 46. Bases 81 are not permanently affixed to cushion slide 40, which allows the removal of cushion pins 80 for maintenance or other purposes.

Figure 3:
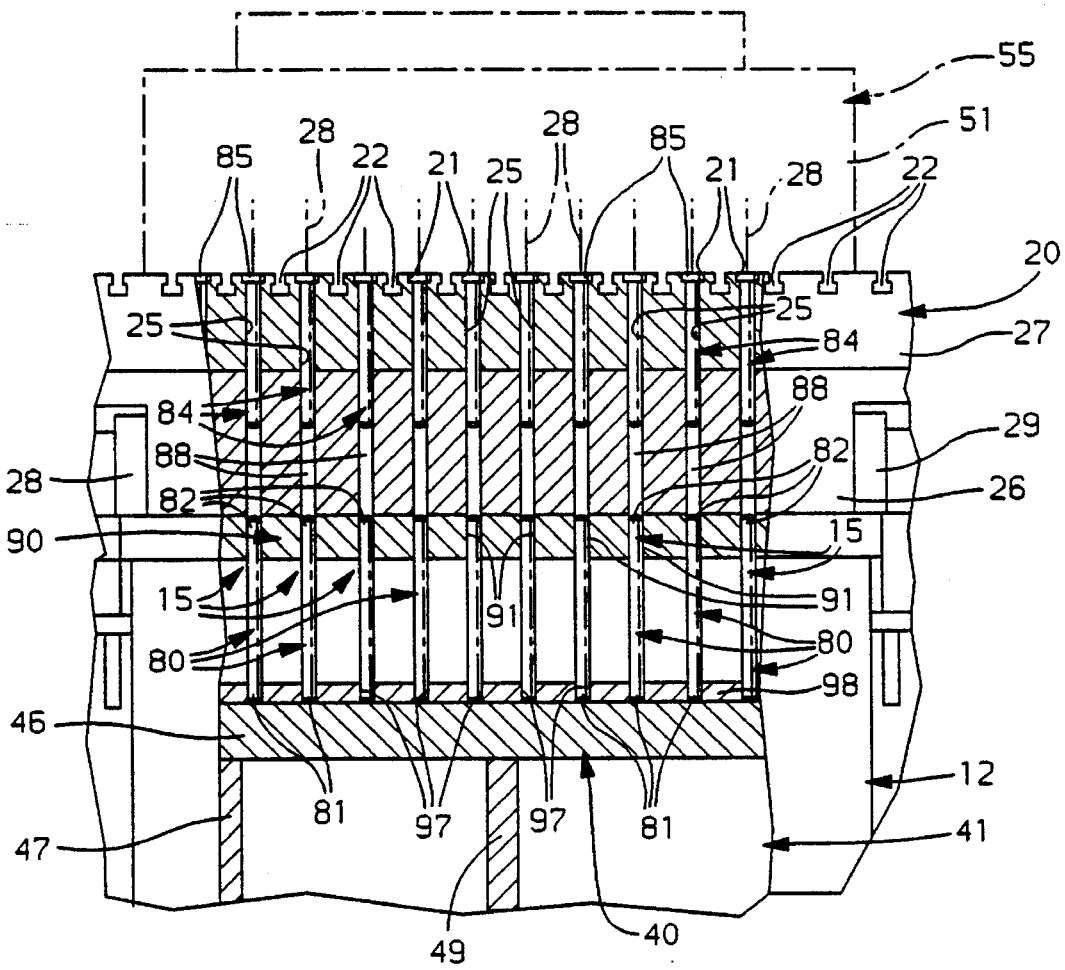
FIG. 3 is a partial cross sectional view of a cushion area of a press.

Referring to FIG. 3, guide plate 98 is mounted to slide 40. Guide plate 98 includes a plurality of openings, represented by openings 97. Bases 81 of cushion pins 80 are received in openings 97 preventing relative horizontal movement between pin bases 81 and cushion slide 40.

Cushion slide 40 is illustrated in FIGS. 1 and 3 in its retracted or lowered position. Referring to FIG. 3, the tops 82, of cushion pins 80 are disposed at or below the top of guide plate 90. Guide plate 90 includes a plurality of openings represented by openings 91 to receive cushion pins 80 therethrough. Guide plate 90 provides a means of maintaining cushion pins 80 in their preselected locations. The axis of each opening in guide plate 90 corresponds to the axis of an opening in guide plate 98.

Bolster 20 includes a plurality of openings represented by openings 25. The openings, though shown in cross section, are arranged in a plurality of rows providing optional locations for the pins 84. Openings 25 include axes 28 and are contiguous with axile cavities 21. The axis of each opening in bolster 20 corresponds with the axis of an opening in guide plate 90.

Openings 25 receive cushion pin extensions 84. Cushion pin extensions 84 include enlarged heads 85 that are received in cavities 21. Because heads 85 are larger than openings 25, cushion pin extensions 84 are carried in the bolster 20 but are movable from this location vertically, so that they can be pushed upward by cushion slide 40 or lifted out of openings 25.

Cushion pin extensions 84 are selectively positioned in the bolster at openings 25 to engage a section of lower die half 55 to provide a secondary motion thereto. When activated, cushion slide 40 moves cushion pins 80 vertically upward so that they engage cushion pin extensions 84. Cushion pin extensions 84 are thereby moved vertically and heads 85 engage the preselected section of lower die half 55. The motion that is provided to the selected section of lower die half 55 is utilized in the forming process of the workpiece that is positioned between the die halves 55 and 52.

Figure 4:
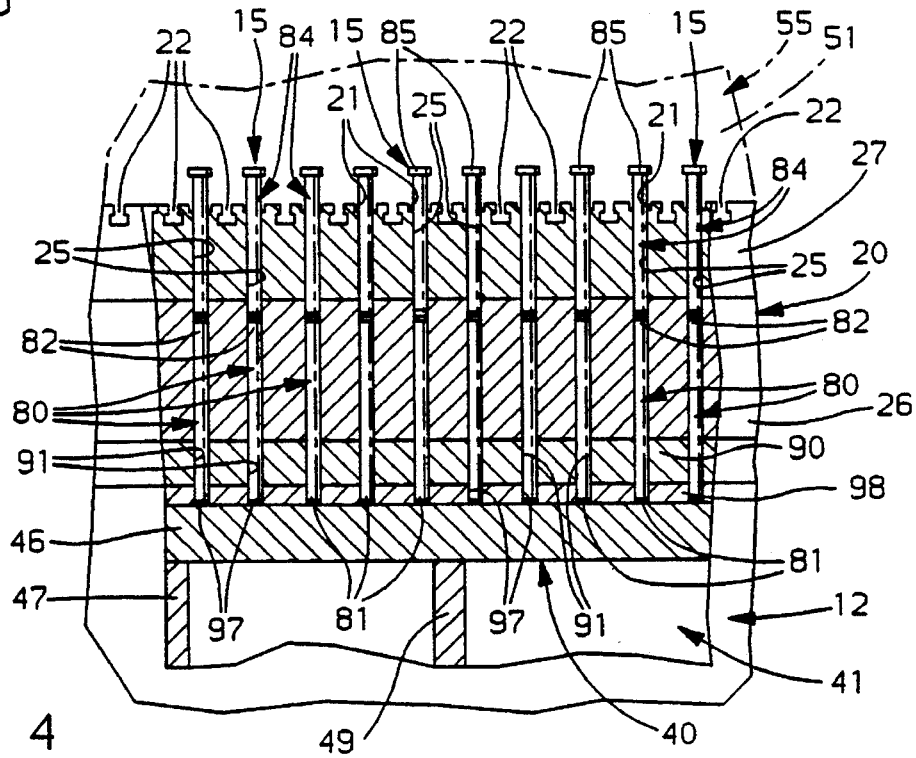
FIG. 4 is a partial cross sectional view of a cushion area of a press.

A typical application utilizing cushion pins according to the present invention is a forming operation. When cushion 41 is activated, cushion slide 40 is forced upward by fluid pressure applied by cylinder 100, shown in FIG. 1. Cushion slide 40 pushes cushion pins 80 upward which, in turn, engage cushion pin extensions 84 forcing them upward as illustrated in FIG. 4. FIG. 4 illustrates the full upward extension of cushion slide 41 without a die being mounted on bolster 20.

Cushion pin extensions 84 are located in the bolster 20 to engage selected parts of lower die half 55 such as binder section 51. Binder section 51 is illustrated in FIG. 1.

Binder section 51 is extended when the cushion 41 is activated. When ram 60 moves upper die half 52 into contact with the extended binder section 51, the perimeter of the workpiece is pinched therebetween prior to forming. As the die halves 52 and 55 are closed by the force of ram 60, binder section 51, cushion pin extensions 84, cushion pins 80 and cushion slide 40 are driven downward by the force. When ram 60 again moves upward, cushion slide 40 drives pins 80 and 84 upward, forcing binder section 51 upward stripping the workpiece from punch 54.

The secondary movement required by components such as binder section 51 will typically, not require all of the cushion pin extensions represented by extensions 84 to be carried within the bolster. Therefore, selected cushion pin extensions may be removed from the bolster prior to the installation of lower die half 55, while the corresponding cushion pins, represented by cushion pins 80, can remain in position within the bed 12 of the press without interfering with the die.

In the present embodiment, openings or gaps 88, shown in FIG. 3, has been left between cushion pins 80 and cushion pin extensions 84. This is required so that bolster 20 can be rolled off of bed 12 with the cushion pin extensions in place clearing the bolster clamp-down cylinders (not illustrated). Providing gaps 88 contemplates a press which includes bolster clamp-down cylinders and provides a rolling bolster system in which the cylinders do not require modification. It is apparent that the size of this gap, which is 5½ inches, is particular to the application and will vary according to the installation requirements.

The split cushion pin system according to the present invention enables rolling bolster 20 out of press 10 in the following manner. Cushion slide 40 is lowered by cylinder 100 to its retracted position as shown in FIG. 1. In this location the tops 82 of cushion pins 80 are disengaged from cushion pin extensions 84. Preferably the ram 60 has been lowered so that upper die half 52 can be disconnected therefrom and allowed to rest on top of lower die half 55. At this point the ram 60 is slightly raised providing clearance and bolster 20 is unlocked and rolled out of the press bed 12 carrying die halves 55 and 52 along with the cushion pin extensions represented by extensions 84 out of the press 10.

Once the bolster has been rolled out of the press, ready access to the die, comprised of die halves 55 and 52, facilitates its removal from the bolster. Die removal reveals the tops of the cushion pin extension heads represented by heads 85. All or some of the cushion pin extensions are removed from bolster 20 at this time and the pin extensions required for the next die are placed in the bolster 20. A new die is then mounted on bolster 20 while it is outside the press bed 12. Bolster 20 is then rolled back into the press bed 12, locked in position, the new upper die half attached to ram 60 and the press 10 is again ready for adjustment and operation.

Figure 2:
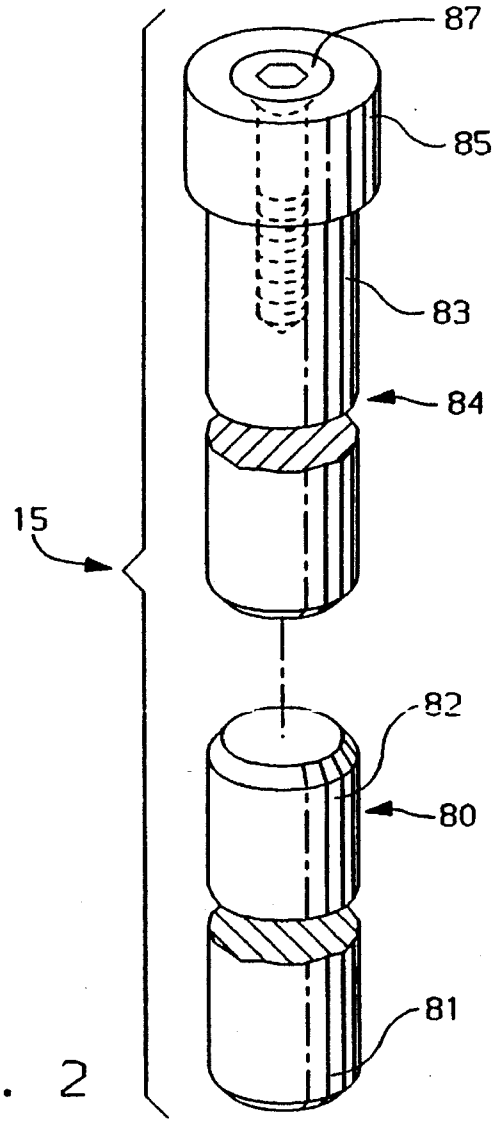
FIG. 2 is a perspective illustration of a pin according to the present invention.

FIG. 2 illustrates in detail the split cushion pin system 15. Cushion pin 80 is a solid cylindrical 18 inch long pin. Cushion pin extension 84 is 14½ inches overall in length. The cushion pin extension 84 includes a solid cylindrical body 83 and a head 85. The head 85 is fixed to the body portion 83, in this case by countersunk bolt 87. Alternatively, pin extension 84 can be made from one piece.

In position, head 85 rests in cavity 21 of bolster 20, preventing the cushion pin extension 84 from slipping through the bolster 20. This structure permits the cushion pin extensions 84 to be carried with the rolling bolster 20 and selectively removed and replaced when the bolster 20 is rolled out of the press bed 12 and the die removed.

In the foregoing manner the removal and replacement of dies and cushion pins is simplified. This system lends itself to application when a rolling bolster system is employed within a forming machine such as a press.

What is claimed is:

1. A machine comprising;

a cushion slidably mounted in the machine;

a rolling bolster movable into and out of the machine a forming tool removably mounted on the rolling bolster;

a plurality of pins extending through the machine selectively engaging the cushion and the forming tool, including a cushion pin carried within the machine and engaging the cushion such that the cushion provides movement to the cushion pin and a cushion pin extension carried within the rolling bolster and engageable with the forming tool, the cushion pin being separate from and selectively engaging the cushion pin extension and providing movement thereto.

2. A press including a bed comprising:

a rolling bolster positioned on the bed;

a die removably mounted on the rolling bolster;

a cushion slide within the bed;

a plurality of cushion pins carried within the bed engaging the cushion slide such that the cushion slide is capable of providing movement to the cushion pins; and a plurality of cushion pin extensions extending partially through and carried by the bolster, positioned to engage the cushion pins and the die.

3. A press according to claim 2 wherein the bolster includes a plurality of bolster openings and the cushion pin extensions comprise an enlarged head portion and an elongated body portion attached thereto, wherein the cushion pin extensions are carried in the bolster openings.

4. A press according to claim 2 further comprising a guide plate mounted in the bed and having a plurality of guide plate openings, wherein the cushion pins extend through the guide plate openings.

5. A press according to claim 2 wherein the bolster has a bottom surface adjacent the bed and a top surface upon which the die is mounted and wherein the cushion pin extension extends from the top surface through the bolster a distance short of the bottom surface so that the bolster can be rolled out of the bed with the cushion pin extensions in place and carried by the bolster.

6. A press having a bed comprising:

a cushion within the bed having a cushion slide with a top plate;

a first guide plate mounted on the top plate having a plurality of first guide plate openings;

a rolling bolster positionable on the bed having a plurality of bolster openings therethrough, coaxial with the first guide plate openings, including an enlarged cavity contiguous with each bolster opening;

a second guide plate mounted on the bed having a plurality of second guide plate openings therethrough coaxial with the first guide plate openings;

a cushion pin carried by the press, extending through one of the second guide plate openings and having an end positioned in one of the first guide plate openings; and a cushion pin extension carried by the rolling bolster positioned in one of the bolster openings and having a head wherein the head is positionable in the enlarged cavity of the bolster opening.

* * * * *